United States Patent [19]

Johnson

[11] 4,055,007

[45] Oct. 25, 1977

[54] EARTH HANDLING APPARATUS

[76] Inventor: Bruce W. Johnson, 2602 Rte. No. 176, Crystal Lake, Ill. 60014

[21] Appl. No.: 656,422

[22] Filed: Feb. 9, 1976

[51] Int. Cl.[2] ..... E02F 5/00

[52] U.S. Cl. ..... 37/126 AE; 214/82

[58] Field of Search ..... 37/124 R, 126 A, 126 AB, 37/126 AD, 126 AE, 129, 117.5, 126 AC; 214/82

[56] References Cited

U.S. PATENT DOCUMENTS

| | | | |
|---|---|---|---|
| 2,993,283 | 7/1961 | Rockwell et al. | 37/124 H |
| 3,052,049 | 9/1962 | Elenburg | 37/124 H |
| 3,079,021 | 2/1963 | Kohorst et al. | 37/126 AE X |
| 3,195,248 | 7/1965 | Martin | 37/124 |
| 3,330,054 | 7/1967 | Martin | 37/124 |
| 3,479,758 | 11/1969 | Johnson et al. | 37/126 R X |
| 3,488,870 | 1/1970 | Holets et al. | 37/129 |
| 3,742,628 | 7/1973 | Walser et al. | 37/124 |
| 3,952,432 | 4/1976 | Boersma | 37/126 AE |

FOREIGN PATENT DOCUMENTS

| | | | |
|---|---|---|---|
| 806,380 | 12/1958 | United Kingdom | 37/126 K |

*Primary Examiner*—E. H. Eickholt
*Attorney, Agent, or Firm*—Lester N. Arnold

[57] ABSTRACT

A box-like receptacle comprises an earth moving and handling apparatus adapted for use as a rear mounted scraper and as a front mounted bucket for digging, loading, transporting and dumping earth material for excavation and landscaping purposes. The receptacle includes a movable end gate effective to move forwardly to dump loaded earth.

The movable end gate is guided in its movement without means of multiple and complicated guide tracks or rollers but instead comprises improved guide means defined by a pair of parallel spaced tubular post members each having a stationary outer sleeve member and a sliding inner sleeve member telescopically received by the outer sleeve member. The free end portion of the inner sleeve members are attached to the rear mid-region of the movable end gate.

1 Claim, 7 Drawing Figures

EARTH HANDLING APPARATUS

BACKGROUND OF THE INVENTION

This invention relates to earth moving and handling apparatus and, more particularly, to a box-like receptacle device functional as a scraper element to be dragged behind a suitable prime mover and as a front mountable bucket element having a ram or push utility.

The prior art is replete with variations of earth moving machinery and apparatus for leveling earth, for scraping earth, for spreading earth, for shoveling earth, and such devices are self-propelled as well as used in trailered combination with a tractor or bulldozer prime mover. It is well known that it is advantageous to provide a means of expelling the earth from the bowels of such earth containers in contrast to elevating or dumping over the bulk of the container body as is employed with gravity dumping techniques. Forced ejection of the earth material enhances the operability and marketability of this type apparatus.

Previously disclosed ejector mechanisms appear to offer a variety of ejector means the most efficient of which is the movable blade or endgate within the confines of the receptacle body which blade forces the loaded earth material to be pushed from the interior of the receptacle. An earth handling apparatus of this type is disclosed in U.S. Pat. No. 2,988,832, issued June 20, 1961. This prior art scraper and other prior art scrapers are thought to utilize unnecessarily cumbersome and ineffective means for guiding the movements of the ejector blades. For example, the ejector blades have been provided with rollers or slides mounted in tracks which are easily clogged and jammed with debris and earth material or which become a problem to remain properly lubricated, or which have a complicated array of guide linkage arms interconnected by a plurality of pivotal axis which require lubrication and constitute a maintenance problem. The guide means of the present invention are improved so as to overcome the difficulties as discussed and are of a simple, relatively maintenance free design not known to be disclosed in the prior art. Further, the guide means of the present invention permit the ejector blade mechanism to move between a forward extended position of dumping and a rearward retracted position of non-interference with loading without the disadvantages of tilting, jamming against side or bottom container walls, breaking linkage pins connecting multiple linkage arms, fouling or clogging guide tracks or experiencing breakdowns due to improper lubrication of movable parts.

SUMMARY OF THE INVENTION

The prior art is not known to disclose a front-mounted earth loading container as is commonly called a bucket which can also be useful as a rear mounted scraper element, and which contains such improved guide means as are disclosed herein for the movement of the ejector blade. In a preferred embodiment of the present invention the receptacle device or container invention employs a blade-like ejector member movable between two positions within the confines of the box-like carrier. The carrier is comprised of a pair of lateral side walls and a bottom wall, defining an opened ended container within which the ejector blade defines an end wall or endgate positioned perpendicularly to the lateral side walls and movable therebetween in closely spaced relationship thereto. The ejector mechanism is movable between a forward extended position wherein the earth material within the interior confines of the receptacle is forcedly expelled and a rearward retracted position wherein the earth material is free to fill the interior space of the receptacle carrier to its maximum capacity. The ejector mechanism is a flat-like blade or endgate powered to move or being propelled by fluid operated jack or piston means and guided by improved guide means comprised of a pair of telescoping tubular post members spaced apart and connected to the ejector blade at a predetermined position with respect to the longitudinal axis of the blade. The telescoping post members in turn are each comprised of an outer stationary tubular member which receives in telescoping relationship thereto an inner inserted sliding tubular member, the free end portion of which is attached to the rear surface of the ejector blade. When used as a scraper element, the receptacle is provided with a surrounding frame structure having a front protrusion or tongue which provides means of attachment to a suitable rear hitch of a tractor such as an adjustable three-point tractor hitch. The framed receptacle is wheel mounted for greater mobility as is common in the practice and the forward edge portion of the bottom wall is shaped to provide a cutter edge or blade for facilitating the scraping and loading of earth material.

The elevating or lowering action of the receptacle scraper from the adjustment of the tractor hitch precipitates the raising or lowering of the cutter blade in its contact reference with the underlying earth. An optional apron mechanism is provided for restraining the spillage of earth during transporting movement of the receptacle scraper. The apron mechanism is operable by means of fluid operated jacks or piston means to move to a retracted position of non-interference with loading or dumping actions.

The receptacle body of the present invention when removed from the supporting frame structure and the wheel mounting therefor comprises a receptacle bucket suitable for front mounted applications with tractors, caterpillars and bulldozers and such. The receptacle bucket is preferably attached to the vehicles by means of maneuverable latterally spaced support arms extending from the front portion of such a vehicle as is common in the practice. These type support arms are maneuverable to provide forward and rearward movement, upward and downward movement and pivotable tilting movement to the receptacle bucket. The receptacle bucket includes the ejector blade mechanism of the receptacle scraper so that earth material can be forcedly ejected therefrom and with the ejector blade in the forward position adjacent the cutter edge, the bucket has a suitable configuration to comprise a ram blade or so-called push or dozer blade. With the ejector blade in the rear position removed from the cutter edge, the receptacle bucket comprises an improved scraper configuration which permits the cutter edge to be spaced from the point of pivot for the bucket by the depth dimension of the bottom wall which performs as shoe means for adding greater stability to the cutter edge. The lateral support arms of the vehicle can be alternatively positioned with respect to the guide means and propelling means of the receptacle bucket so as to avoid interference with each other and to accommodate a variety of vehicles which have varying widths and extendability for the lateral support arms.

It is therefore an object of the present invention to provide an earth handling receptacle apparatus attachable to a prime mover vehicle which alternatively comprises either a rear mounted receptacle scraper or a front mounted receptacle bucket.

It is another object of the invention to provide such an earth handling receptacle apparatus including an ejector mechanism for forcedly ejecting earth material therefrom.

It is still another object to provide improved guide means attached to the ejector mechanism for providing uniform smooth movement of the ejector blade within the receptacle and which is relatively maintenance free.

It is a further object of the invention to provide a receptacle which comprises a ramming or pushing device with the ejector blade fixed in its foremost position adjacent to the forward end portion of the receptacle scraper or receptacle bucket.

These and other objects of the present invention will be understood through a consideration of the improved details of structure of the preferred forms and embodiments as disclosed herein in connection with the accompanying drawing, wherein:

THE DRAWING

DETAILED DESCRIPTION

Figure 1:
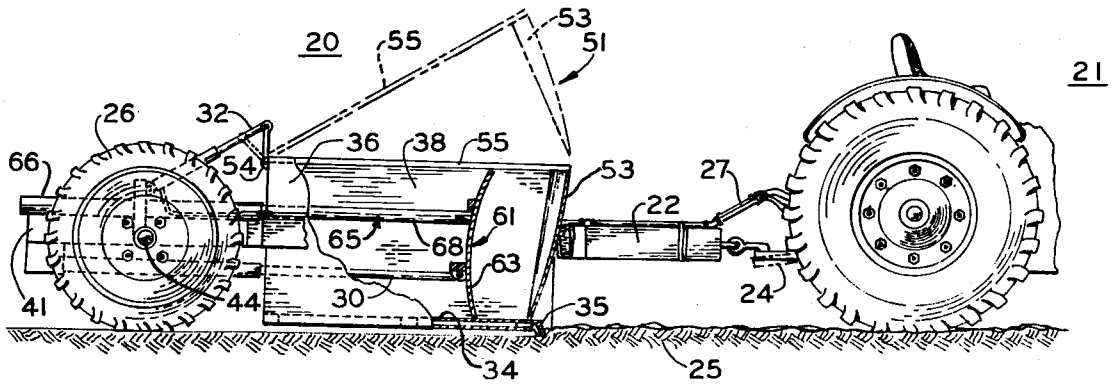
FIG. 1 is a side view of the receptacle device of the present invention used as a receptacle scraper and showing a pivotable apron and a rear portion of a tractor vehicle attached thereto.

Referring now to the detailed drawings, there is shown in FIG. 1 an earth moving and handling receptacle 20 embodying the principles and preferred features of the present invention and being shown as a trailer type implement pulled by a tractor vehicle 21, only a portion of which is shown for illustration purposes. The receptacle 20 is shown in a preferred embodiment as a receptacle scraper sometimes referred to in the art as a pull-type scraper wherein the receptacle frame structure 22 is attached on its forward end portion to the tractor 21 by the provision of an elevating hitch means such as a so-called three-point hitch 24 and the rear end portion of which is supported by ground 25 engaging wheels 26. Suitable fluid lines 27 are extended from the tractor 21 to the receptacle scraper 20 for use in operating several fluid jacks or pistons such as the main hydraulic cylinder 30 and the smaller hydraulic cylinder 32 both to be discussed more fully hereinafter.

Figure 3:
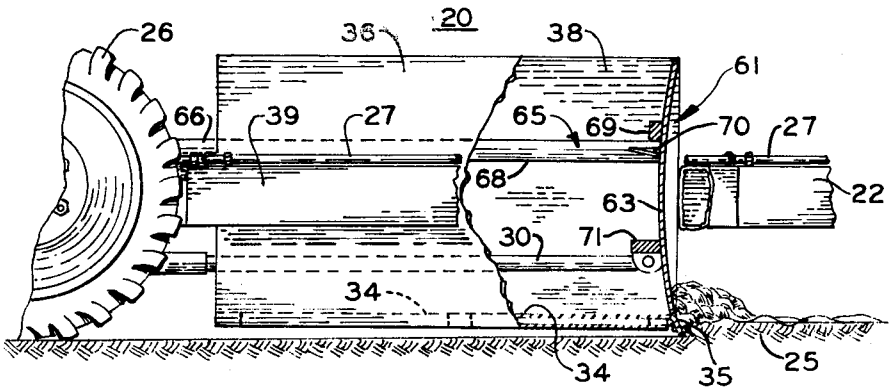
FIG. 3 is a similar side view of the receptacle scraper showing an ejector blade in a forward position and a cutter blade on the forward edge portion of the bottom wall thereof.
Figure 2:
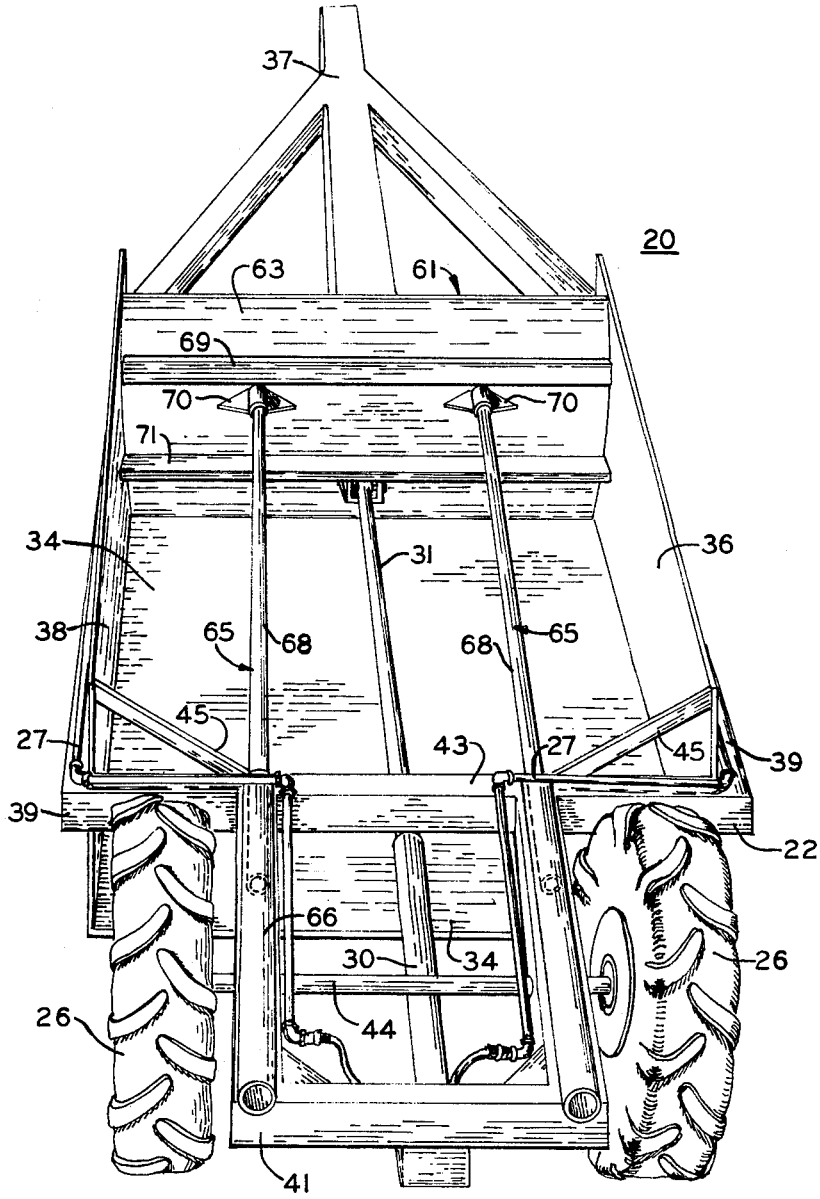
FIG. 2 is a rearward perspective view of the receptacle scraper of FIG. 1 without attachment to the tractor vehicle.

The receptacle scraper 20 is shown in FIGS. 1, 2 and 3 to include a frame structure 22 and a body defined by a bottom wall 34 and a pair of opposite lateral side walls 36 and 38. The bottom wall has its forward edge portion configured to provide a depending cutter edge or blade 35. The frame structure 22 is constructed of a plurality of tubular members of generally rectangular cross-section framing the peripheral of the receptacle body along the side walls 36 and 38. The forward portion of the frame structure 22 is provided with a triangular shaped extending tongue portion 37 to be attached by suitable connector means to the elevational adjustable tractor hitch 24. Side members 39 of the frame structure 22 extend along the mid-region of the side walls 36 and 38, respectively, and provide a convenient support surface for the hydraulic fluid lines 27 to be located outside of the interior of the receptacle body. The tractor means 21 is provided with a suitable hydraulic system driven by the tractor motor (not shown) for applying desired fluid pressure to the hydraulic system to operate the hydraulic cylinders 30 and 32. The side members 39 are interconnected by a rear cross member 43 to which is connected a projecting portion of the frame 22 herein referred to as a table frame extension 41. A pair of the wheels 26 are mounted on axle means 44 to define a wheel assembly to be attached to the table frame extension 41. The forward movement of the scraper 20 is made smoother with less reaction to the uneven surface of the underlying earth 25 by providing wheels of larger diameter desirably approximately as large in diameter as the height dimension of the scraper 20 when attached to the tractor means 21. It is to be noted also that the cutter edge 35 is spaced adequately forward of the wheel assembly to provide a greater smoothness to the grading action of the scraper through removal from the wheel axle 44. A pair of angle brace members 45 extend from the rear cross member 43 upwardly to the rear upper corners of the side wall 36 and 38, respectively, for adding strength and rigidity to the side walls.

There is shown in FIG. 1 an apron mechanism 51 having a forward wall member 53 and top brace members 55 such as a pair of brace members spaced apart to engage opposite corners of the apron forward wall 53. The apron mechanism 51 is pivotably mounted to suitable attachment means 54 near the rear upper corners of the side walls 36 and 38 and is movable to a raised position, as indicated in dashed lines in FIG. 1, with respect to the forward end of the receptacle scraper 20 so as to be removed from interference with dumping and loading operations of the receptacle scraper 20.

As is conventional in the related art, the apron mechanism 51 is raised and lowered by means of fluid operated cylinders such as the hydraulic cylinder 32 suitably linked to the pivotal attachment means and effective to cause the movement of the apron 51 through contracting and extending the piston rod, respectively. Preferably, there are provided a pair of hydraulic cylinders 32, only one of which is shown in FIG. 1. As is shown clearly in FIGS. 1 and 2, with the apron mechanism 51 either raised or removed, the forward end portion of the receptacle body is open ended. It is to be understood that the apron mechanism 51 is useful for restraining the spillage of earth during transporting movement of the receptacle scraper 20 but that such an apron mechanism is optional and is not an essential feature of the present invention.

In accordance with the present invention, the receptacle body 20 is provided with a movable ejector mechanism 61 for expelling or ejecting loaded earth material. The ejector mechanism includes a generally flat blade-like plate or endgate 63, improved guide means 65 and the fluid operated main hydraulic cylinder 30. The improved guide means 65 and the main cylinder 30 cooperate to provide the uniform smooth movement of the ejector blade 63 between a forward extended position wherein the loaded earth material would be dumped and a rearward retracted position of non-interference with the loading of earth material during trailer dragging of the receptacle scraper 20. The extent of travel of the ejector blade is preferably substantially the entire forward to rearward length or depth dimension of the bottom wall 34 for maximum potential of the full load capacity of the receptacle scraper 20.

The guide means 65 are comprised of a pair of generally tubular telescoping post members having either rectangular or circular cross-sections, each post member includes an outer stationary sleeve or casing element 66 mounted to the table frame extension 41 and aligned to receive an inner sliding core or casing element 68 which has its free end portion attached as at 70 by suitable connection means to the rear of the movable ejector blade 63. The pair of guide members 65 are parallel spaced with respect to each other and are connected to the ejector blade 63 in a common horizontal plane generally along the mid-region of the rear surface of the blade 63. The ejector blade 63 includes a horizontal strut or rib 69 along its rear surface preferably positioned above the attachment plane of the inner guide posts 68. Another horizontal strut or rib 71 is provided along the lower portion of the rear surface of the ejector blade 63 as is clearly shown in FIG. 2. The ejector blade 63 is propelled by the main hydraulic cylinder 30 which is conveniently mounted on the table frame extension 41 and has the free end portion of its piston extension 31 attached by suitable connector means to the rear surface of the ejector blade 63. It is common practice in the art to provide movement of ejector blades through propelling movement of actuable fluid operated jack or piston means, and it is to be noted that a single hydraulic cylinder such as 30 could be employed or a pair of smaller piston means could be utilized without affecting the novelty of the improved guide means 65.

It can be seen from a consideration of the drawings, that the guide means 65 are the primary supports for the suspended position of the ejector blade 63 aside from some weight bearing utility of the main cylinder 30. The interior surfaces of the side walls 36 and 38 and the interior surface of the bottom wall 34 are entirely smooth. The adjacent edge portions of the ejector blade 63 are closely spaced from the side walls 36 and 38 and the bottom wall 34 but do not make actual contact therewith in order to provide an improved uniform and smooth movement of the ejector blade 63 within the interior confines of the receptacle body 20 without the difficulties of tilting, jamming or jerking of the blade 63 or the clogging of guide tracks along these surfaces which might provide sliding engagement with the blade 63 with a roller mounted blade. The edge portions of the ejector blade 63 are spaced from the receptacle walls in a manner to prevent actual contact therewith but so as to remove substantially all earth material from the receptacle body including sticky or gummy earth materials.

The ejector blade 63 is movable under the power of the main cylinder 30 over substantially the entire length from front to rear of the bottom wall 34 for providing maximum loading and dumping of the earth material. With the movements of the blade 63, the inner sliding casing elements 68 of the guide posts 65 are telescopingly received within the larger outer stationary casing elements 66. This telescoping arrangement allows maximum support and guidance to be provided to the moving ejector blade 63 and requires a minimum of maintenance and lubrication. The guide posts are easily cleaned and are placed well away from direct contact with loaded earth material. Further elevating or lowering of the receptacle scraper 20 is accomplished by means of the adjustable tractor hitch 24 working about the rear wheel axis as a pivot point, and the ejector blade 63 always moves directly into or away from the alignment openings of the outer casing elements 66.

As is best shown in FIG. 3, the forwardmost position of the ejector blade 63 provides for the ejector blade 63 to be aligned with the cutter edge 35 on the front edge portion of the bottom wall 34 so as to form a generally continuous front blade surface particularly useful in grading applications wherein it is not desired to load earth material into the receptacle scraper 20. The cutter edge 35 is set to depend from the bottom wall 34 at approximately a 45° angle below the horizontal plane of the bottom wall 34 and constitutes the digging tool edge for the receptacle scraper. The cutter edge 35 is made from the heavy plate thickness of the bottom wall 34 so as to provide the capacity to scrape or dig into hard packed or frozen earth materials as well as loosely packed earth materials. It has been noted that a relatively small adjustment in the tilt angle of the receptacle scraper 20 relative to the wheel axle 44 results in a relatively large adjustment in the scraping action of the cutter edge 35 because of the exaggerated downward depending angle of the cutter edge 35 with respect to the bottom wall 34. For maximum scraper action from the receptacle scraper 20, the width of the scraper 20 is made relatively equal to or the same as the width of the intended tractor prime mover.

Figure 4:
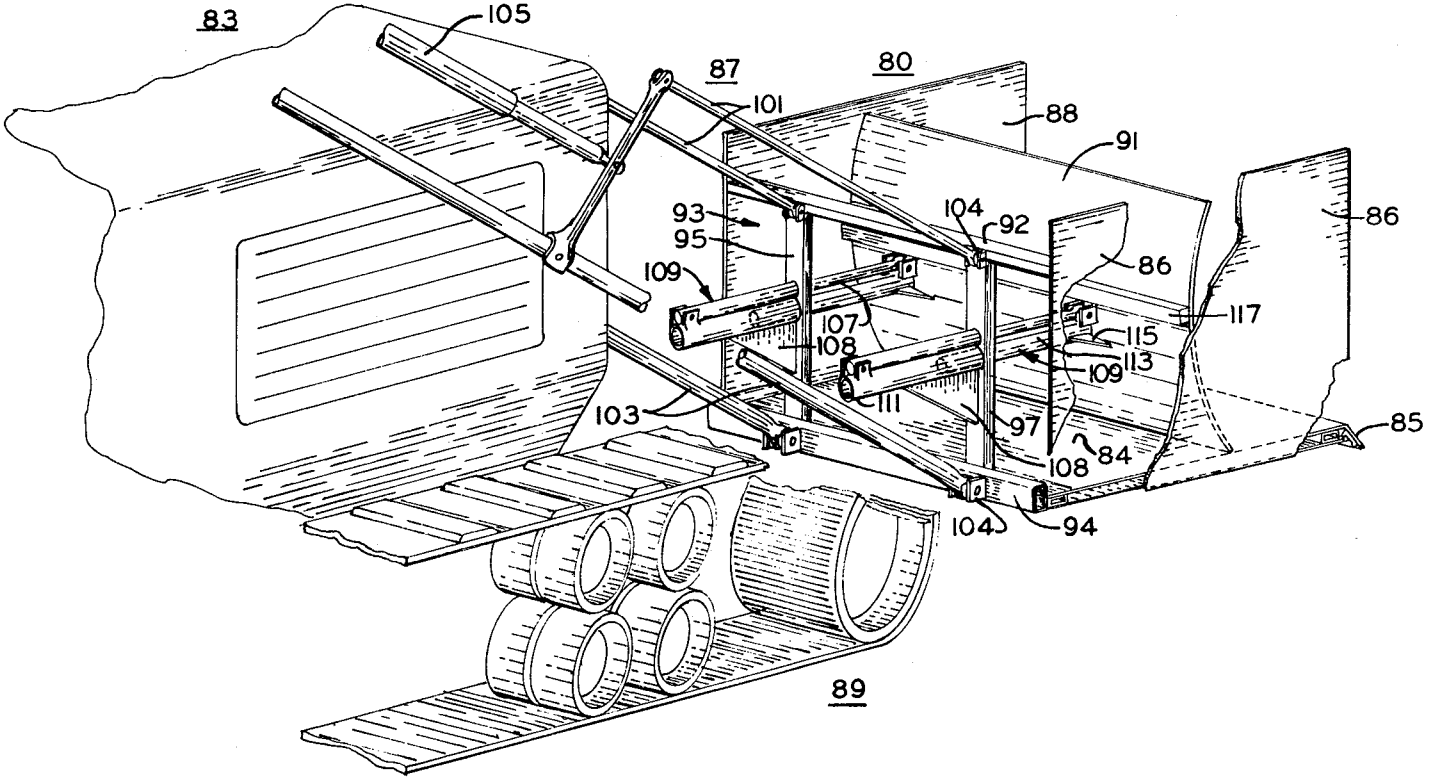
FIG. 4 is a generally side perspective view of the receptacle device used as a receptacle bucket.

In another preferred embodiment of the invention, FIG. 4 shows a receptacle bucket means 80 mounted to the front end of a suitable tractor vehicle means 83 (only a portion of which is shown) having caterpillar type track assembly 89. The receptacle bucket 80 is attached by means of a plurality of maneuverable lateral support arms shown generally at 87. The receptacle bucket 80 is defined by a bottom wall 84 and a pair of oppositely spaced lateral side walls 86 and 88. There is provided a movable blade-like plate or endgate 91 positioned to extend perpendicularly between the side walls 86 and 88 in closely spaced relationship thereto. The combination of the side walls 86 and 88, the bottom wall 84 and the endgate 91 in a rear position thereof define a box or bucket shaped receptacle for receiving excavated earth materials.

The rear portion of the receptacle bucket 80 is provided with a frame structure 93 comprised of a pair of parallel spaced horizontal bars or frame members 92 and 94 and a pair of parallel spaced vertical bars or frame members 95 and 97. The bars 92 and 94 provide rigidity and support to the side walls 86 and 88, and the bars 95 and 97 in combination therewith, provide the integral frame structure 93 to which a pair of lateral upper support arms 101 and a pair of lateral lower support arms 103 are pivotal connected by pinned connector means indicated at 104 in FIG. 4. The support arms 101 are moved by contraction and expansion of the connecting hydraulic cylinder means 105, other means of propelling the movement of the lateral support arms 101 and 103 not being shown but which are commonly known in the prior art. The lateral support arms 101 and 103 cooperate to impart upward and downward movements, forward and rearward movements and tilting upward and downward movements to the front mounted receptacle bucket 80 to facilitate its employment as a front scraper, grading, digging or filling tool.

To the purposes for which the receptacle bucket 80 is intended, there is provided a cutter edge or blade 85 on the forward edge portion of the bottom wall 84 and depending downwardly therefrom at approximately a 45° angle from the horizontal. Further, the movable plate or endgate 91 is provided with propelling means through the provision of a pair of fluid actuated hydraulic cylinder means 107, and is provided stability, support, smoothness and uniform movement through the provision of improved guide means 109. Both the hydraulic cylinder means 107 and the improved guide means 109 are supported by the frame structure 93 as by insertion through suitable apertures in the vertical frame members 95. Underlying wedge plates 108 provide support to the rearwardly extending hydraulic cylinder means 107 and the guide means 109.

In a like manner to that discussed in connection with the disclosure of the receptacle scraper 20, the improved guide means 109 is comprised of a pair of generally tubular post members each having an outer hollow sleeve or casing element 111 and an inner sliding core or casing element 113 the free end portion of which is attached as at 115 by suitable connector means to the rear surface of the movable ejector plate 91. The pair of guide members 109 are parallel spaced with respect to each other and are supported in a common horizontal plane generally intersecting the ejector plate 91 along the mid-region thereof. The ejector plate 91 includes a horizontal strengthening strut 117, and other struts may be provided as needed. Again, it is to be noted that the interior surfaces of the side walls 86 and 88 and the bottom wall 84 are smooth and do not contain guide tracks or grooves used to guide the forward and rearward movements of the ejector plate 91. The edge portions of the ejector plate 91 are closely spaced from the side walls 86 and 88 and the bottom wall 84 so that maximum dumping of loaded earth material can be achieved.

It has been noted in experimental use of the present invention that these improved guide posts support the weight of the ejector plate 91 quite adequately when made with a suitable length dimension. There is no minimum or maximum lengths discussed herein as the factors of weight and size of the plate 91 and the depth of the receptacle bucket 80 must be considered and such applications are well known in the practice. It has been noted, however, that the telescopic sliding movement of the guide means 109 is not noticeably lessened or adversely affected by the weight bearing utility thereof. Further, the improved guide posts 109 provide a minimum of maintenance and lubrication and can be placed in an area of maximum protection or minimum exposure to the earth materials being loaded and dumped.

Most configurations of ejector blades as disclosed in the prior art employ rolling or sliding engagement support tracks located along the inner adjacent surfaces of the side walls and bottom wall of these type receptacles. It is readily apparent that these tracks are exposed to the earth materials being loaded and dumped and thus the tracks are easily clogged and require a greater applied force in moving a blade therealong. Adequate lubrication becomes another problem. Other configurations of ejector blades have been noted which do not utilize weight bearing support engagement between the ejector blade and the main support walls of the receptacle, but none have been noted which utilize a sliding support and guide post arrangement such as disclosed herein. Further, it is to be noted that the actual connection of the hydraulic cylinders 107, as well as cylinders 30 and 32, to hydraulic fluid lines, such as fluid lines 27, have not been shown for the reason that the implementation of such connections are fully understood in the art, and would be unnecessarily cumbersome in the accompanying drawing.

It should be understood from a consideration of FIG. 4 that as the fluid operated jack means 107 are caused to extend the associated piston means forwardly, the individual inner casing element 113 slides forwardly from within the outer casing element 111, the pair of inner casing elements 111 supporting the weight of the ejector plate 91 and their uniform movement imparting a smooth uniform forward movement to the attached ejector plate 91. The reverse movement of the plate 91 in a rearward direction is the result of the contraction of the piston means of the jack means 107. The length dimension of the guide means 109 are such that the inner casing elements 113 are still well received within the associated outer casing element 111 when the ejector plate 91 is in its forwardmost position adjacent to the cutter edge 85. It is more convenient to utilize a pair of the fluid jacks 107 with the receptacle bucket 80 because of the possibility of interference with the lateral support arms 87, and to relocate the fluid jacks 107 upwardly from the lower position of the jack 30 so as to allow greater tilting movement of the front mounted receptacle bucket 80.

The ejector plate 91 is particularly useful when positioned forwardly of the receptacle bucket 80 to a position adjacent the cutter edge 85 wherein the receptacle bucket 80 is provided with a so-called push, ram or dozer blade. This position is as shown in FIG. 3 for the receptacle scraper 20 wherein the blade 63 is shown in a forward position with its lower edge portion nearly contiguous to the cutter edge 35 so as to provide a continuous-like dozer blade having a cutter edge and a wide front surface. Likewise, the lower edge portion of the plate 91 is positioned nearly contiguous to the cutter edge 85 so as to provide a flat-like dozer blade having a cutter edge. The depth of the bucket 80 provides a desirable distance from the cutter edge 85 and the pivotal connection 104 of the bucket 80 to the arms 87, which distance comprises a levered-like control over the elevational action of the cutter edge 85. This structural provision is sometimes referred to in the practice as a shoe structure. Although not shown in the drawing, it is noted herein that conventional skirts or side plates could be mounted in front of the cutter edge 85 so as to comprise side extensions of the side walls 86 and 88 and thereby provide a configuration much like the so-called Jersey spreader. However, such an apron mechanism would interfere with pushing earth materials flush with a wall of a building.

Figure 5:
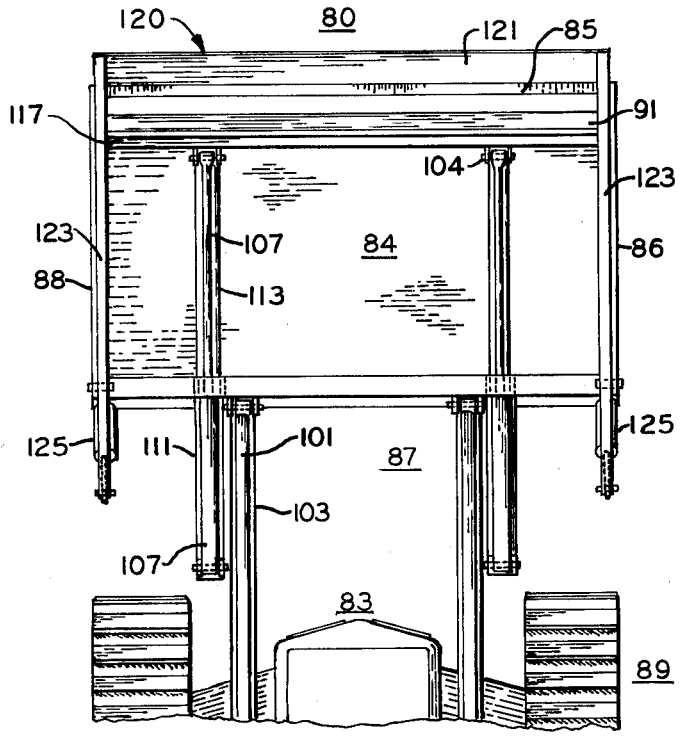
FIG. 5 is a top view of the receptacle bucket of FIG. 4.

FIG. 5 shows a top view of the mechanism of FIG. 4 and includes in addition thereto, an optional apron mechanism 120 having a front wall 121, upper side struts or brace members 123 and is preferably activated through the provision of a pair of fluid operated jacks or pistons 125. The ejector plate 91 is shown in its forwardmost position adjacent the cutter edge 85.

Figure 6:
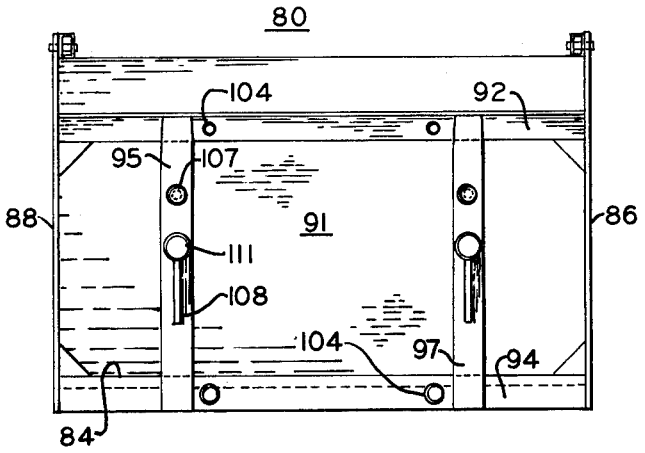
FIG. 6 is a rear view of the receptacle bucket of FIG. 4.
Figure 7:
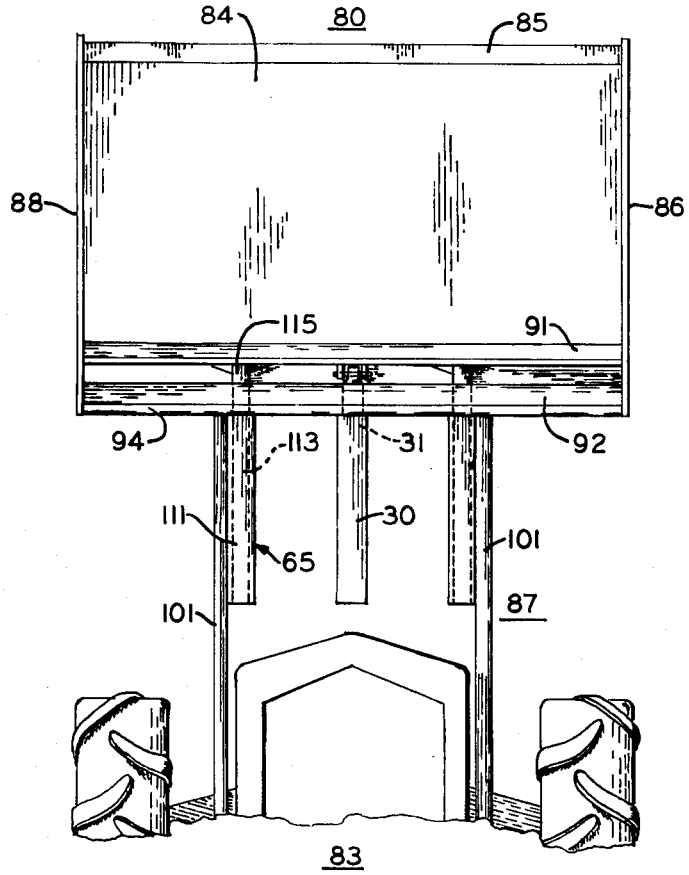
FIG. 7 is a top view of an alternative receptacle bucket.

FIG. 6 shows that the horizontal plane of connection for the fluid operated jacks 107 is removed in spaced relationship from the horizontal plane of connection for the guide means 109. This spacing is thought to aid in preventing tilting or pitching movement of the ejector plate 91. The combined guide means 109 and fluid operated jacks 107 are shown positioned outside (as viewed in FIGS. 5 and 6) of the lateral support arms 87 of the tractor means 83. This offset relationship between the lateral support arms, such as the upper arms 101 and the lower arms 103, and the guide means 109 and the jacks 107, eliminate possible interference therebetween with various movements of the front mounted bucket 80. FIG. 7 shows a top view of the receptacle bucket 80 wherein the lateral support arm assembly 87 is preferably positioned outside (as viewed in FIG. 7) of the guide means 65. This view is shown to illustrate that the spacing and placement of the extending support arms of different type prime movers are not all the same, and suitable changes in the placement of the guide means 65 and the fluid operated jacks, such as the use of the single main hydraulic cylinder 30, can be made. The guide means 65 of FIG. 7 is comprised of the outer casing element 111 and telescopically received inner casing element 113. The main hydraulic cylinder 30 has the extendable piston 31 attached to the ejector plate 91 for actuation thereof in accordance with the operation described hereinbefore.

It is to be understood that while the present invention has been shown and described with reference to the preferred embodiment thereof, the invention is not to be limited to the precise circuits and logic arrangements set forth, and that various modifications and changes may be made by those skilled in the art without departing from the spirit and scope thereof.

What is claimed is:

1. An earth handling apparatus for handling loaded earth materials comprising frame means, walled enclosure means having at least a bottom wall and a pair of oppositely disposed sidewalls extending perpendicularly to engage said bottom wall, said enclosure means having at least one open-ended portion disposed forwardly thereof, and said bottom wall including cutter means adjacent to said open-ended portion, a movable end wall actuable to move forwardly and rearwardly of said bottom wall and being supportedly positioned for transverse extension between said side walls with the edge portions thereof depended in closely spaced relationship with and free of attachment and engagement with said side walls and bottom wall, means for actuating said end wall to move forwardly and rearwardly of said enclosure means, improved guide means supportingly positioning said end wall and comprising pairs of telescopically engaged inner and outer post members, said outer post members thereof fixedly supported on said frame means in parallel spaced alignment with said side walls, said inner post members thereof being supportedly received within said outer post members, respectively, and slideably engaged thereby, said inner post members being supported solely by said outer post members during sliding engagement therewith, said inner post members including free end portions thereof, respectively, being attached to said end wall substantially interiorly of said edge portions thereof and being disposed on an opposite side of said end wall from loaded earth materials, both said inner and outer post member pairs being free of attachment to and spaced substantially interiorly of said side walls, and said end wall being supported solely by said inner post members with said end wall in both forward and rearward positions thereof, whereby said guide means are protected during the excavating of said earth materials.

* * * * *